United States Patent [19]

VanErden

[11] Patent Number: 4,923,309

[45] Date of Patent: May 8, 1990

[54] TAMPER-EVIDENT PACKAGE

[75] Inventor: Donald L. VanErden, Wildwood, Ill.

[73] Assignee: Illinois Tool Works, Glenview, Ill.

[21] Appl. No.: 315,801

[22] Filed: Feb. 27, 1989

[51] Int. Cl.[5] ..... B65D 33/16; B65D 33/34

[52] U.S. Cl. ..... 383/5; 383/61; 383/63; 206/610; 206/628; 206/632; 53/410

[58] Field of Search ..... 383/5, 61, 63, 65, 93, 383/94; 206/610, 628, 632, 632; 53/410

[56] References Cited

U.S. PATENT DOCUMENTS

| | | | |
|---|---|---|---|
| 2,333,587 | 11/1943 | Salfisberg | 206/632 |
| 3,198,228 | 10/1962 | Naito | 150/3 |
| 3,226,787 | 1/1966 | Ausnit | 383/61 X |
| 3,419,137 | 12/1968 | Walck | 206/628 X |
| 3,473,589 | 12/1966 | Gotz | 150/3 |
| 3,780,781 | 12/1973 | Uramoto | 150/3 |
| 4,191,230 | 3/1980 | Ausnit | 383/61 |
| 4,617,683 | 10/1986 | Christoff | 383/63 |
| 4,657,792 | 4/1987 | Ausnit | 383/63 X |
| 4,744,674 | 5/1988 | Nocek | 383/63 |
| 4,786,190 | 11/1988 | VanErden et al. | 383/61 |
| 4,823,961 | 4/1989 | Griesbach et al. | 383/61 X |

FOREIGN PATENT DOCUMENTS

| | | | |
|---|---|---|---|
| 239319 | 9/1987 | European Pat. Off. | 383/61 |
| 1029854 | 6/1953 | France | 206/628 |

*Primary Examiner*—Stephen Marcus
*Assistant Examiner*—Jes F. Pascua
*Attorney, Agent, or Firm*—Hill, Van Santen, Steadman & Simpson

[57] ABSTRACT

A package has wall panels defining a product receiving space and providing a bag mouth arrangement between upper end portions of the wall panels which have a hermetic peel seal and a reclosable fastener with a tamper evident tear-off strip closing the upper ends of the upper portions. The tear-off strip has at least one digitally engageable ear to facilitate tearing off of the strip.

5 Claims, 1 Drawing Sheet

TAMPER-EVIDENT PACKAGE

BACKGROUND OF THE INVENTION

This invention relates in general to the packaging art, and is more particularly concerned with a new and improved tamper evident package.

In U.S. Pat. No. 4,786,190 dated Nov. 22, 1988, of Donald L. VanErden and Hugo Boeckman, there is disclosed a bag type package having a mouth end with a nonreclosable peel seal above which is a reclosable fastener of the type which can be opened by pulling apart flange portions above the reclosable fastener whereby to open the reclosable fastener, after which the peel seal can be opened by continuing pull apart opening force. Thereafter, the reclosable fastener can be utilized to reclose the package if desired, but the peel seal remains permanently open after it has once been opened for access into the package.

However, insofar as the package disclosed in said copending application is concerned, there is no superficial tamper evident feature, that is, something at the outside of the package that would make any tampering immediately obvious, so that if the reclosable fastener is opened and the peel seal opened surreptitiously, the package can be closed by means of the reclosable fastener and then it may be overlooked that the peel seal has been disturbed. This may be of particular concern where the package is displayed for sales purposes. For some products, it is highly desirable that the product be hermetically sealed within the package for shelf life and to maintain freshness of the product as well as to maintain product free from contamination. The peel seal provides hermetic seal assurance; and in a sense may be considered a tamper evident nonreclosable closure means. However, because the peel seal is located inwardly relative to the reclosable fastener, the package is subject to apprehension of possible pilfering or tampering which may not be detected until the reclosable fastener has been legitimately opened to gain access to the peel seal closure.

While U.S. Pat. Nos. 3,198,228, 3,473,589 and U.S. Pat. No. 3,780,781 disclose reclosable profile fasteners or zippers, and a tear-off or tear-open top on the bag for access to the zipper, there is no disclosure in those patents of a bag or package that has the hermetic seal advantages of a peel seal inwardly relative to the reclosable fastener.

SUMMARY OF THE PRESENT INVENTION

An important object of the present invention is to provide a new and improved bag or package structure having a pilfer/tamper evident feature together with a reclosable fastener and a peel seal nonreclosable closure.

Another object of the invention is to provide a new and improved bag or package equipped with a hermetic peel seal nonreclosable closure and a reclosable fastener, and pilfer/tamper evident means which must be destructively passed to gain access to the reclosable fastener and the peel seal closure.

According to the present invention there is provided a package having opposed wall panels secured together and defining a receptacle space therebetween, and comprising a package mouth defined between upper end portions of said wall panels which extend between opposite sides of the package; a one-time openable nonreclosable peel seal closure means extending in a relatively narrow band from side-to-side of the package and securing said panels together substantially below the upper ends of said upper end portions and initially maintaining said mouth fixedly closed;, reclosable fastener means located below said upper ends of said upper end portions, but above said peel seal closure means and functioning for maintaining said mouth closed after said non-reclosable peel seal closure means has been opened; said fastener means being reclosable by digital pressure applied theretoward on the outer faces of the wall panel areas, and being adapted to be manually pulled open and reclosed for selectively opening and closing said mouth; and pilfer/tamper evident means securing said upper end portions against separation and requiring permanent destruction of said pilfer/tamper evident means before access can be had to said fastener means, so that after said pilfer/tamper evident means has been destroyed, said fastener means can be opened, if closed, responsive to digital pullapart force applied to said upper end portions of the wall panels for gaining access to said non-reclosable peel seal closure means, and said non-reclosable peel seal closure means being then openable by continuing pullapart force applied to said upper end portions of said wall panels, after said fastener means has been pulled open, for gaining complete access into said receptacle space, and said fastener means being thereafter reclosably closable as the sole closure for the package mouth.

BRIEF DESCRIPTION OF THE DRAWINGS

Other objects, features and advantages of the present invention will be readily apparent from the following detailed description of representative embodiments thereof, taken in conjunction with the accompanying drawing, although variations and modifications may be effected without departing from the spirit and scope of the novel concepts embodied in the disclosure, and in which.

DETAILED DESCRIPTION

Figure 1:
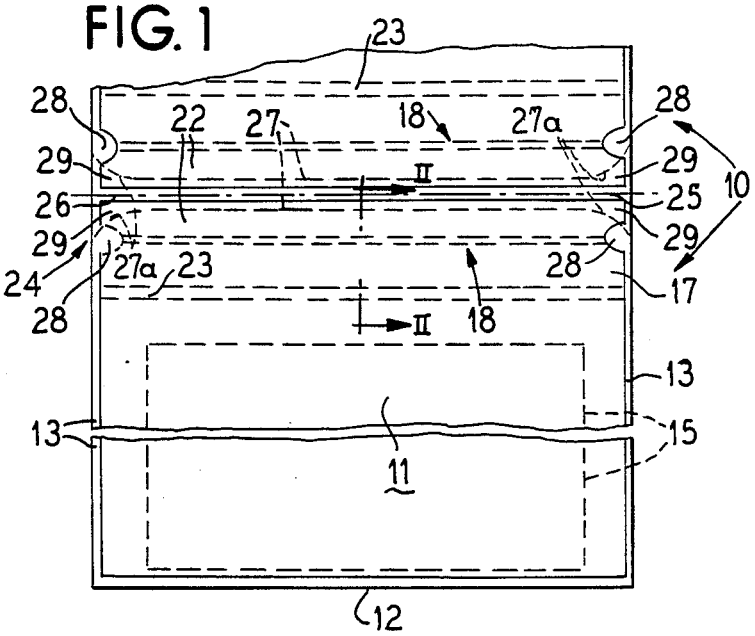
FIG. 1 is a fragmental plan view of a package structure embodying the present invention.
Figure 2:
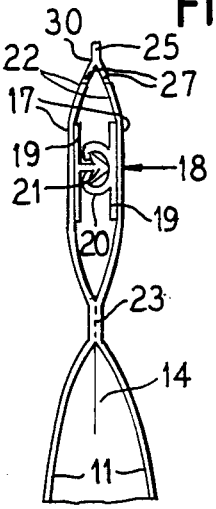
FIG. 2 is an enlarged fragmentary sectional detail view taken substantially along the line II—II in FIG. 1.

A bag or package structure 10 as shown in FIGS. 1 and 2, and embodying the present invention, comprises wall panels 11 which may be plastic film and may be hermetically sealed along a bottom heat sealed seam 12 and hermetically sealed along side heat seal seams 13. This encloses a product receiving space 14 within which any desired product 15 may be packaged.

At the upper or mouth end of the package 10, the wall panels 11 have upper end portions 17 provided with a reclosable fastener means 18 which in the present instance comprises a zipper having complementary extruded plastic profiled fastener strips 19, one of which is permanently connected to the inside of one of the portions 17 and the other of which is permanently connected to the inside of the other of the portions 17. One of the fastener strips 19 has a groove shaped profile 20 which receives an aligned rib shaped profile 21 on the other of the fastener strips in a releasably interlocked manner so that the zipper 18 can be opened by pulling apart upward flange extensions 22 of the portions 17 and applying pull apart force sufficient to unsnap the zipper profiles which have been previously snappingly interlocked by opposed pressure applied to the outside of the portions 17.

Spaced inwardly from the reclosable fastener 18 is a hermetic peel seal closure 23 which extends across the package 10 and together with the bottom seal 12 and the side edge seals 13 fully hermetically seals the product space 14.

Figure 5:
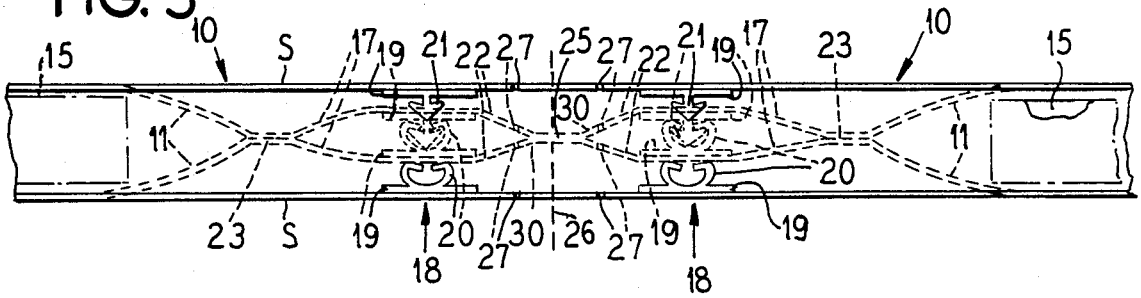
FIG. 5 is a schematic view demonstrating certain steps in assembling and completing the package.

Tamper evident means 24 are provided at the top ends of the pull flange extensions 22. To this end, the upper ends of the flange extensions 22 are permanently sealed as by means of a heat seal seam 25 which at its opposite ends joins the contiguous ends of the side seals 13. As shown in FIGS. 1 and 5, two of the packages 10 may be formed head-to-head so that a common double width seam 25 connects the packages. Then the double width seam 25 may be split along a median line 26 to separate the packages, and with the single width seam 25 intact on each package.

A line of weakening 27 such as perforations extends on each of the flange extensions 22 parallel and adjacent throughout a major extent length from side-to-side of the respective flange extensions 22 and with the ends of the lines of weakening 27 comprising down turns 27*a* which are preferably turned arcuately downwardly and extending across the side seams 13 at spot seals 28 and which spot seals seal the ends of the zipper 18 to the side seams 13. This affords handy digitally engagable ears 29 at the opposite ends of a destructively removable tamper evident tear-off strip 30 defined by the coincident lines of weakening 27.

Figure 3:
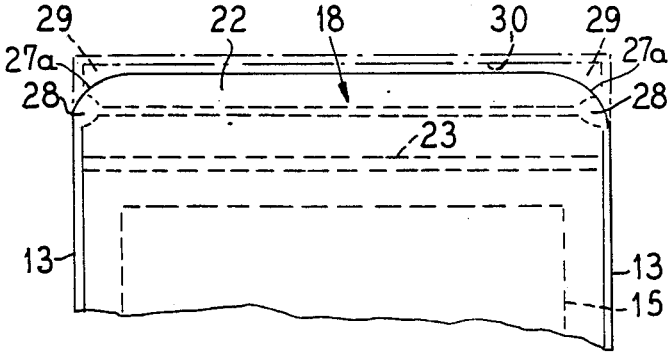
FIG. 3 is a fragmentary plan view similar to FIG. 1 but showing the package with the tamper evident means destructively removed for opening the package.
Figure 4:
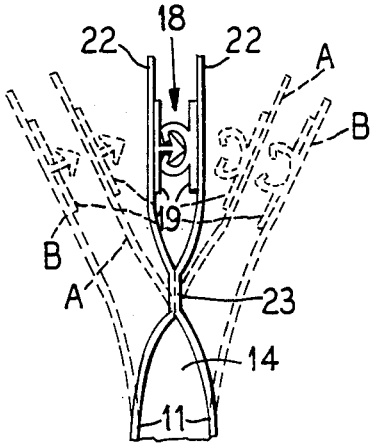
FIG. 4 is a sectional detail view taken substantially along the line IV—IV in FIG. 3.

For gaining entrance into the product space 14, therefore, it is necessary first to remove the tear-off strip 30 which can be readily accomplished by grasping one of the ears 29 and ripping the tear-off strip from the top ends of the flange extensions 22. This leaves the package 10 in the condition shown in FIGS. 3 and FIG. 4 wherein the top ends of the flange extrusions 22 are free from one another. Then, by grasping the flange extensions 22 and pulling them apart, the zipper 18 can be opened by applying pull apart separation force in opposite directions to the wall panel portions 17, as seen at schematic A. By continuing the pull apart force to the peel seal 23, the peel seal is permanently opened, as seen at schematic B. When it is desired to reclose the package, the reclosable zipper 18 is closed by applying closing pressure thereto from opposite sides through the panel portions, and the zipper returns to the condition shown in full lines in FIG. 4.

In FIG. 5 is shown schematically how two package making film strips S capable of producing two lines of packages 10 can be fed along a production line to receive the product 15 within the product space areas of the packages and the strips S then brought together, the respective peel seals 23 formed, the zippers 18 closed, the joint top seals 25 completed and the thus formed lines of packages 10 separated by severing the joint top seals 25 longitudinally along the median line 26. Either at this time or prior the lines of weakening or perforations 27 may be formed. After the lines of packages 10 have been separated as stated, the individual packages 10 in each line may be separated from each other before or after being filled with product 15.

Figure 6:
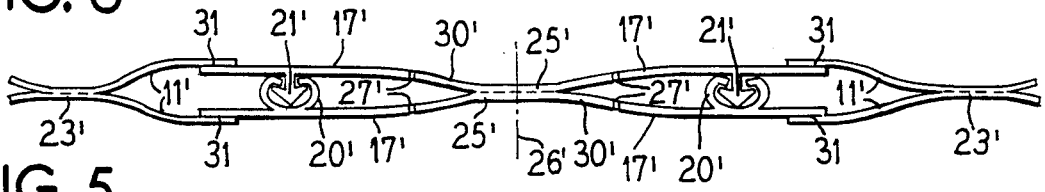
FIG. 6 shows a modification.

In FIG. 6 is shown a modification of the disclosure in FIG. 5 in that the wall panels 11' are primarily formed from sheet material such as plastic film of suitable gauge, but the upper end portions 17' are provided in the form of extruded plastic fastener strips attached to the wall panel sheet material as by means of fusion welding or hot melt adhesive at 31. The reclosable fastener means 18' comprises integral extruded plastic interlockable fastener profiles 20' and 21' on the strips 17'. Initially the strips 17' are of double width, with two sets of the profiles 20' and 21', and with these sets of profiles spaced sufficiently to provide ample material for provision of the joint top seal 25' for the two lines of packages 10' which are adapted to be separated from one another along the median severance line 26'. Just as discussed in connection with FIG. 5, the individual package 10' is in each line may be separated from each other before or after being filled with product.

The peel seals 23' are formed across the sheet body portions of the panels 11' and spaced from the joints 31. The lines of weakening or perforations 27' are formed in the head-to-head upper portions 17' of the lines of bags 10' so that after the separation 26' there will be provided for each of the bags 10' a destructively removable pilfer/tamper evident tear-off strip 30'.

It will be understood that variations and modifications may be effected without departing from the spirit and scope of the novel concepts of the present invention.

I claim as my invention:

1. A package having opposed wall panels secured together and defining a receptacle space therebetween, and comprising:

a package mouth defined between upper end portions of said wall panels and which extend between opposite sides of the package;

a one-time openable non-reclosable peel seal closure means extending in a relatively narrow band from side-to-side of the package and securing said panels together substantially below the upper ends of said upper end portions and initially maintaining said mouth fixedly closed;

reclosable fastener means comprising a plastic extruded profile zipper assembly extending from side-to-side of the package and located below said upper ends of said upper end portions, but above said peel seal closure means and functioning for maintaining said mouth closed after said non-reclosable peel seal closure means has been opened;

said zipper assembly having spot seals at said opposite sides of the package;

said zipper assembly being reclosable by digital pressure applied theretoward on the outer faces of the wall panel areas, and being adapted to be manually pulled open and reclosed for selectively opening and closing said mouth; and pilfer/tamper evident means securing said upper end portions against separation and comprising a permanent connection extending from side-to-side of the top ends of said upper end portions, and a line of weakening extending throughout most of its length parallel to and adjacent to said connection requiring permanent destruction of said pilfer/tamper evident means by tearing off of a top end strip comprised of said upper end portions when it is desired to gain access into the package;

said lines of weakening turning downwardly at their ends to the side edges of said package and across said spot seals;

so that after said pilfer/tamper evident means has been destroyed, said fastener means can be opened, if closed, responsive to digital pullapart force applied to said upper end portions of the wall panels for gaining access to said non-reclosable peel seal closure means, and said nonreclosable peel seal closure means being openable by continuing pullapart force applied to said upper end portions of said wall panels, after said fastener means has been pulled open, for gaining complete access into said receptacle space, and said fastener means being thereafter reclosably closable as the sole closure for the package mouth.

2. A method of making a package having opposed wall panels secured together and defining a receptacle space therebetween, and comprising:

providing a package mouth defined between upper end portions of said wall panels and which extend between opposite sides of the package;

providing a one-time openable non-reclosable peel seal closure means extending in a relatively narrow band from side-to-side of the package and securing said panels together substantially below the upper ends of said upper end portions and initially maintaining said mouth fixedly closed;

providing reclosable fastener means comprising a plastic extruded profile zipper assembly extending from side-to-side of the package and located below said upper ends of said upper end portions, but above said peel seal closure means and functioning for maintaining said mouth closed after said non-reclosable peel seal closure means has been opened;

providing said zipper assembly with spot seals at said opposite sides of the package;

said zipper assembly being reclosable by digital pressure applied theretoward on the outer faces of the wall panel areas, and being adapted to be manually pulled open and reclosed for selectively opening and closing said mouth; and providing pilfer/tamper evident means and thereby securing said upper end portions against separation, and comprising providing a permanent connection extending from side-to-side of the to ends of said upper end portions, and providing a line of weakening extending throughout most of its length parallel to and adjacent to said connections and requiring permanent destruction of said pilfer/tamper evident means by tearing off of a top end strip comprised of said upper end portions when it is desired to gain access into the package;

turning said lines of weakening downwardly at their ends to the side edges of said package and across said spot seals;

so that after said pilfer/tamper evident means has been destroyed, said fastener means can be opened, if closed, responsive to digital pullapart force applied to said upper end portions of the wall panels for gaining access to said non-reclosable peel seal closure means, and said non-reclosable peel seal closure means being openable by continuing pullapart force applied to said upper end portions of said wall panels, after said fastener means has been pulled open, for gaining complete access into said receptacle space, and said fastener means being thereafter reclosably closable as the sole closure for the package mouth.

3. A method of making a package having opposed wall panels secured together and defining a product receiving space therebetween, and comprising:

forming said wall panels primarily from sheet material;

providing a package mouth defied between upper end portions of said wall panels and which extend between opposite sides of the package;

permanently closing the upper ends of said upper end portions;

providing a reclosable extruded plastic fastener comprising interengageable fastener profiles;

providing lines of weakening across said upper end portions adjacently below said upper ends of said upper end portions whereby to define a tear off strip;

providing a separable fastener spaced below said lines of weakening and providing spot seals at ends of said fastener at the opposite sides of said package;

extending the opposite end portions of said line of weakening across said spot seals; and providing a peel seal closure spaced below said reclosable fastener;

whereby it is necessary to tear off said tear-off strip before gaining access through said reclosable fastener to said peel seal for opening said peel seal to gain access into said product receiving space.

4. A method according to claim 3, which comprises providing said tear off strip with ear means adjacent to said spot seals and facilitating digital manipulation for tearing off said strip.

5. A method according to claim 4, which comprises providing said ear means by the turning of said lines of weakening downwardly across said spot seals.

* * * * *